US006820624B1

(12) United States Patent
Palmeri

(10) Patent No.: US 6,820,624 B1
(45) Date of Patent: Nov. 23, 2004

(54) HAIR TREATMENT AND STYLING METHOD

(75) Inventor: Glenna Dee Palmeri, Tustin, CA (US)

(73) Assignee: Jeana Dee + Friend, Corp., Tustin, CA (US)

( * ) Notice: Subject to any disclaimer, the term of this patent is extended or adjusted under 35 U.S.C. 154(b) by 207 days.

(21) Appl. No.: 10/180,664

(22) Filed: Jun. 26, 2002

(51) Int. Cl.[7] ..... A45D 24/00
(52) U.S. Cl. ..... 132/200
(58) Field of Search ..... 132/200, 222, 132/202, 208, 270

(56) References Cited

U.S. PATENT DOCUMENTS

| | | | | |
|---|---|---|---|---|
| 896,600 A | | 8/1908 | Thornton | |
| 2,007,088 A | | 7/1935 | Jones | 229/87 |
| 2,139,311 A | | 12/1938 | Moore | 132/36.2 |
| 2,178,984 A | | 11/1939 | Zimmerman | 24/204 |
| 3,349,781 A | * | 10/1967 | Poole et al. | 132/208 |
| 3,779,448 A | | 12/1973 | Wootten | 229/48 R |
| 4,398,549 A | | 8/1983 | Thomas | 132/9 |
| 4,672,983 A | | 6/1987 | Nath et al. | 132/7 |
| 5,007,443 A | | 4/1991 | Fulgoni | 132/270 |
| 5,056,538 A | * | 10/1991 | Matula | 132/208 |
| 5,058,609 A | | 10/1991 | Sandoz et al. | 132/270 |
| 5,146,937 A | | 9/1992 | Lefebvre | 132/208 |
| 5,335,679 A | | 8/1994 | Baxter | 132/270 |
| 5,349,970 A | * | 9/1994 | Razzouq | 132/208 |
| 5,535,764 A | * | 7/1996 | Abramson | 132/200 |
| 5,562,111 A | * | 10/1996 | Torres | 132/270 |
| 5,664,590 A | | 9/1997 | Plateroti et al. | 132/270 |
| 5,810,024 A | | 9/1998 | Crites | 132/210 |
| 5,816,268 A | | 10/1998 | Awaijane | 132/208 |
| 5,849,421 A | | 12/1998 | Stephan | 428/603 |
| 5,860,431 A | | 1/1999 | Abercrombie et al. | 132/208 |
| 6,012,464 A | | 1/2000 | Hollowell et al. | 132/202 |
| 6,431,181 B1 | * | 8/2002 | Torres | 132/270 |

FOREIGN PATENT DOCUMENTS

| | | | |
|---|---|---|---|
| EP | 0126618 | 11/1984 | A45D/19/00 |
| EP | 0251968 | 1/1988 | A45D/19/00 |
| FR | 2643239 | 2/1989 | A45D/19/00 |

* cited by examiner

*Primary Examiner*—John J. Wilson
*Assistant Examiner*—Robyn Doan
(74) *Attorney, Agent, or Firm*—Cohen, Sakaguchi & English LLP

(57) ABSTRACT

A method for treating and/or styling selective sections of hair on a person's head is disclosed. The method includes the use of a substantially transparent polymer film having a thickness of approximately 0.025 mm. The hair is weaved in order to isolate the sections of hair to be treated. The film is placed against the hair to be treated and a chemical is applied to the hair. Typically, rolling or folding the film onto itself accomplishes sealing or bonding of the film. Optionally, a second film is placed over the first film with the treated hair contained between the two films. Static conductivity facilitates sealing of the film or films. The film or films as a result of the sealing or bonding contain the section of hair and chemical. Chemical development, accelerated by the static conductivity, is observed through the substantially transparent film. Hair, isolated during the treatment process, can be cut with the film and chemical in place, by cutting right through the thin film and hair at the same time. When the desired hair treatment results are achieved, the film or films and chemical are removed from the hair.

30 Claims, 4 Drawing Sheets

HAIR TREATMENT AND STYLING METHOD

FIELD OF INVENTION

The present invention relates generally to a method of treating hair. More particularly, the present invention relates to methods or techniques used for selectively treating and/or styling a person's hair.

INCORPORATION BY REFERENCE

The contents of each U.S. patent or other reference, if any, cited in this application, are hereby incorporated herein by reference.

BACKGROUND OF INVENTION

The style of a person's hair can be an important means of self-expression. The style of an individual's hair including length, cut, texture, and color immediately presents an image for the rest of the world to scrutinize and assess. The need for advanced hair styling techniques in order to provide persons with creative self-expressive options cannot be over stated.

Coloring is a specific hair styling treatment that can add interest and attractiveness to a person's hair. At one time, coloring or highlighting of the hair was limited to bleaching, dying, streaking and/or tinting. In recent years, coloring or highlighting of the hair have included advanced color blending and color weaving that enable the hair stylist to integrate a plurality of color into the hair, i.e., the ability to selectively color precise sections of hair.

Many techniques have been developed for treating hair, which have advantages and disadvantages and which provide varying degrees of success, depending upon the skill of the operator and other factors. There are three generally recognized methods of treating hair: cap highlighting, foiling, and the use of a transparent polymer.

In cap highlighting, a person's hair is covered with a cap made of a flexible material having a plurality of small holes. Using a small tool, the person's hair is pulled through the individual holes. Coloring of the hair then takes place on the selected hair sections. This method is subject to a number of problems. The liquid coloring often "bleeds" through the holes in the cap and the bleach or coloring spreads unevenly to strands or portions of hair not intended to be highlighted. Furthermore, pulling of the hair through the small cap holes can be uncomfortable.

Foiling involves the use of aluminum foil strips. The foil strips are folded around a section of hair to be treated together with the treating chemical or material in paste form. The foil is then folded in half, sandwiching the hair segment between the top and bottom halves The sides of the foil are then folded in an attempt to keep air away from the chemically treated hair. This procedure is repeated for each segment of hair to be highlighted. Foil highlighting is a highly used method of treating hair but suffers from a number of disadvantages. Foiling is a cumbersome and slow process. Unless the treatment is done precisely, there is a tendency for dry spots to develop due to the inability of the foil to provide an adequate seal. In addition, there is a tendency for leakage or slippage to occur due to movement of the person's head or a slip by the stylist. In addition, the stylist, due to the opaque nature of the foil material, cannot adequately observe the progress of the treatment. In addition, heat, needed to speed the chemical process, damages the hair.

In recent years, the use of a transparent polymer or other plastic has gained favor due to the stylist's ability to better monitor the hair coloring chemical process. One such prior art method uses a transparent plastic with a thickness of approximately 0.050 mm. Such plastic does not effectuate an optimal seal to contain the chemical additive placed on the hair to be treated. Such plastic is heavy, cannot be folded or rolled, and may slip due to the combined weight of the plastic, chemical additive, and hair, resulting in the undesirable mixing of chemicals. Furthermore, with such thickness of plastic in place the stylist is unable to cut the hair, thereby prohibiting a precision high-level styling of the person's hair.

Accordingly, there is a need for a method to selectively treat and/or style precise sections of hair that is more efficient, highly effective, reliable, and cost effective than known methods.

SUMMARY

The present invention describes a method to selectively treat and/or style precise sections of hair that is more efficient, highly effective, reliable, and cost effective than known methods.

The film used in the present invention comprises a polymer or plastic material. Suitable materials from which the film may be made include polystyrene, polyvinyl chloride, polyethylene and polypropylene. The preferred material is a substantially planar, substantially rectangular, substantially transparent, film made of polyethelyne terethylate (PET) having thickness less than 0.050 mm and greater than or equal to 0.025 mm. A film with a thickness (thinness) within the aforementioned range is referred to herein as a "thin film."

Extensive testing has resulted in a finding that compared to a film equal to or greater than 0.050 mm, the thin film: (1) increases static conductivity, resulting in shorter chemical process time, greater sealing or bonding strength, and reduced slippage of the film and bleeding of the treatment; (2) allows the hair to be cut with the thin film and chemical in place; (3) reduces weight; (4) retains durability; (5) improves handling characteristics; and (6) lowers operating costs.

Typically, the process begins when an individual desires to have his or her hair styled. Generally, hair styling includes a modification or alteration of the length, cut, texture, and/or the color of a person's hair. These modifications further include straightening, conditioning, bleaching, dying, tinting, and the advanced coloring techniques of color blending and color weaving that enable the hair stylist to integrate a plurality of color into the hair.

One method of the present invention begins when a salon stylist or other person weaves a section of a person's hair in order to selectively isolate the section of hair for treatment or highlighting purposes. In one embodiment of the present invention, a single thin film is used on each section of hair. The thin film is placed against the selected section of hair and a chemical is applied to the section of hair. The thin film is sealed in order to contain the chemical. Typically, rolling or folding the thin film onto itself so that static conductivity facilitates bonding of the thin film accomplishes the sealing of a single thin film.

Alternatively, multiple thin films may be used in accordance with the present invention. The thin films are placed against each other, containing the sectioned hair and chemical between the two thin films. Static conductivity facilitates sealing or bonding between the two thin films. Generally, when two thin films are used to contain or sandwich the sectioned hair and chemical, there is no need to roll or fold the thin film. Typically, static conductivity allows the thin films to bond together in a substantially flat arrangement.

The use of single or multiple thin films allow the stylist to cut a person's hair with the thin film(s) and chemical in place. The ability to cut the hair with the thin film(s) and chemical in place facilitates a precision high-level style. The thin film isolates the hair during the treatment process. The hair no longer has to be separated, after the film and chemical have been removed, from the other hair in order to cut the hair.

The present invention as described herein thus provides a method to selectively treat and/or style precise sections of hair that is more efficient, highly effective, reliable and cost effective than known methods.

DETAILED DESCRIPTION

Figure 1A:
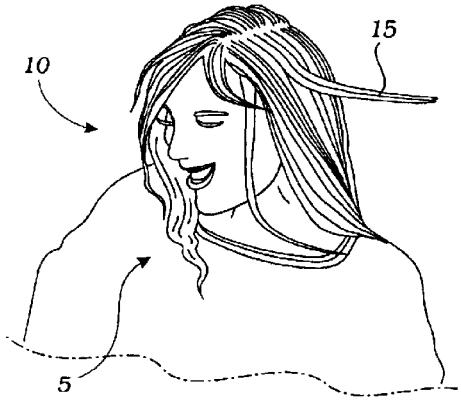
FIGS. 1*a*-1*e* illustrate hair treatment methods used in accordance with the present invention.

The present invention describes a method for selectively treating and/or styling selective sections of hair on a person's head. The method includes the use of a polymer or plastic film having a thickness of less than 0.050 mm and greater than or equal to 0.025 mm. A film with a thickness (thinness) within the aforementioned range is referred to herein as a "thin film." The hair is weaved in order to isolate the sections of hair to be treated. The thin film is placed against the hair to be treated and a chemical is applied to the hair. Typically, rolling or folding the thin film onto itself accomplishes sealing or bonding of the thin film. Optionally, a second thin film is placed over the first thin film with the treated hair contained between the two thin films. Static conductivity facilitates sealing of the thin film or films. Sealing or bonding of the thin film or films contains the section of hair and chemical. Chemical development, accelerated by the static conductivity, is observed through the substantially transparent thin film. When the desired hair styling and/or treatment results are achieved, the thin film or films and chemical are removed from the hair. The present invention thus provides a method to selectively treat and/or style precise sections of hair that is more efficient, highly effective, reliable, and cost effective than known methods.

Turning now to FIGS. 1*a*-1*d*, a representation of the hair treatment methods used in accordance with the present invention are shown. Typically, the process begins when an individual 5 desires to have his or her hair 10 treated. Generally, hair treatment includes styling, e.g., a modification or alteration of the length, cut, texture, and/or the color of a person's hair. Modification or alteration may further include straightening, conditioning, bleaching, dying, tinting, and the advanced coloring techniques of color blending and color weaving that enable the hair stylist to integrate a plurality of color into the hair.

Coloring weaving is the ability to selectively color precise sections of a person's hair so that color variations, including shades and highlights, are blended into the hair. Color weaving allows vivid eye-catching color styles such as streaks to be introduced in the hair. For example, individual 5, possessing dark hair, e.g., black or brown, may desire to have a bright red or white highlight added to a section 15 of hair. Alternatively, multiple sections 45, 50 of hair, as shown in FIG. 1*d*, may be highlighted with a more subdued color, e.g., auburn, to give the impression that the sun has highlighted the hair. The subtle introduction of shades or highlights gives a more natural look to the hair. This type of artificial highlighting of a person's hair is one way an individual 5 may attempt to portray an athletic or youthful appearance.

As used in accordance with the present invention, a section 15 or sections 45, 50 of hair is understood to mean any portion of a person's hair that is less than the entire head of hair. For example, a section 15 of hair may include a single strand of hair or it may include hundreds or thousands of strands or more. Further, the term chemical or chemicals as used in accordance with the present invention encompasses any paste, solid, or liquid solution that may be used to modify, change, alter or vary any aspect, property, or characteristic of a person's hair either permanently or temporarily. Such chemicals, for example, colorings, straighteners, conditioners, etc., are well known in the art.

Figure 1B:
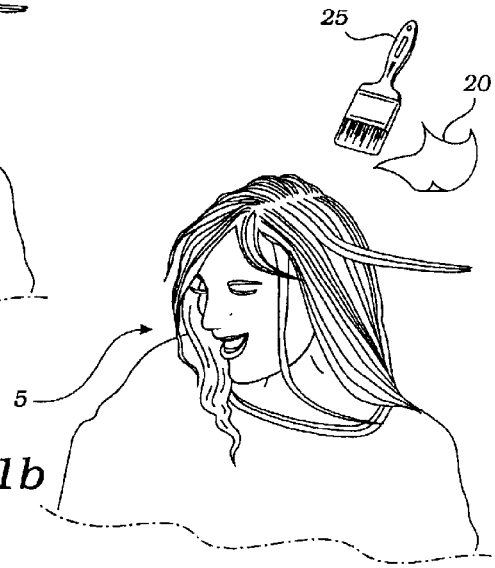

One method of the present invention, as shown in FIG. 1*b*, begins when a salon stylist or other person weaves a section 15 of hair in order to selectively isolate the section of hair for treatment or highlighting purposes. A thin film 20, as further described herein, is placed against the section 15 of hair and/or the person's scalp. Placement of the thin film 20 against the section 15 facilitates contact or touching between the thin film 20 and the section 15 of hair. A chemical is then applied to the section 15 of hair and the thin film 20 is sealed in order to contain the chemical. Typically, rolling or folding the thin film 20 onto itself accomplishes sealing or bonding, because static conductivity facilitates bonding of the thin film 20. The chemical may be applied with a brush 25 as is known in the art.

Currently, film having a thickness equal to or greater than 0.050 mm is used in the field of 15 hair care. Although adequate for some applications, such film is cumbersome to handle in that the film is not adequately suited for folding on to itself. In addition, the film does not optimally contain chemicals that are applied to the hair due to insufficient static conductivity. Furthermore, with such film in place the stylist is unable to cut the hair, thereby prohibiting a precision high-level styling of the person's hair. Finally the film tends to slip from the combined weight of the film, hair, and chemical.

The thin film used in the present invention comprises a polymer or plastic material. Suitable materials include polystyrene, polyvinyl chloride, polyethylene and polypropylene. The preferred material is a substantially planar, substantially rectangular, substantially transparent, film made of polyethelyne terethylate (PET) having thickness of approximately 0.025 mm. The material properties of the preferred thin film e.g., thickness and chemical composition, contribute to significantly improved results that are much greater than would have been predicted, compared to those offered by using other films, such as the thicker 0.050 mm film. For example, the static conductively between two portions of the thin film is substantially greater than between similar portions of the thicker 0.050 mm film. There are at least two advantages of increased static conductivity. First, static conductivity accelerates the development process of the chemicals used to treat a person's hair. Second, increased static conductivity improves the film's ability to contain chemical solutions once the chemicals are applied to an individual's hair; in other words, there is improved sealing or bonding properties between films.

A shorter chemical processing time is highly desirable in that it decreases the overall time required for the hair treatment process. Similarly, a shorter chemical processing time allows the stylist to be more efficient. Additionally, heat does not need to be applied to the hair in order to hasten the chemical process. The application of heat can result in damage to the hair.

Likewise, improved sealing or bonding between thin films, as a result of static conductivity, is highly desirable in that the thin films are better able to contain the chemicals after they are applied to the hair. Improved sealing between thin films prevents leakage, bleeding and seepage between different chemical solutions, e.g., colors. Prevention of chemical bleeding or seepage enables the stylist to selectively color precise sections of hair more effectively. Also, improved sealing facilitates adherence of the film to the hair. Firm adherence of the thin film to the hair prohibits the thin film from slipping, further contributing to the containment of the chemical solutions. Furthermore, firm adherence of the film reduces the possibility of having air trapped between the thin films. Trapped air causes the chemicals used to treat the hair to not process or develop correctly, resulting in uneven or blotchy sections of hair.

Films with thickness of approximately 0.050 mm, 0.038 mm, 0.025 mm,, and films having a thickness below 0.025 mm have been tested in order to determine ideal film characteristics. It has been determined that film having a thickness of less than 0.050 mm and greater than or equal to 0.025 mm exhibits the best film properties, and particularly a film with a thickness of 0.025 mm. A thickness of 0.025 mm as used in accordance with the present invention is approximately equal to 1 mil, or 0.001 inches.. Other ranges of thickness of the thin film may be 0.049 mm to 0.025 mm, 0.038 mm to 0.025 mm, and approximately 0.025 mm. During testing, a substantial increase of static conductivity was observed when using the thin film. The test results appear to be counterintuitive. A person skilled in the art of treating hair would expect, given the same material composition, that a thicker film would generate a greater static charge than a thin film. Furthermore, during testing, it was observed that as film thickness decreased below 0.025 mm, static conductivity no longer increased, but decreased. This test anomaly appears to be linked to a film property herein referred to as "material recovery."

Material recovery, i.e., the tendency of a material to retain its original shape, appeared to be directly proportional to the film's thickness and, generally, inversely proportional to the film's static conductivity. Direct proportionality between a material's thickness and the material's tendency to retain its original shape comes as no surprise. Similarly, as two oppositely electrically charged materials move closer together the attraction between the material increases. Testing confirmed the aforementioned expectations. But, film thickness below approximately 0.025 mm unexpectedly exhibited reduced static conductivity. I believe that this unexplained. result is connected to material recovery. Thus, extensive testing of various film thicknesses has revealed that a film less than 0.050 mm and greater than or equal to 0.025 mm imparts a substantial, yet unexpected, improvement in static conductivity over films of relatively greater or lesser thickness, without compromising durability.

The thin film's thinness did not compromise its durability. Although, the thin film is difficult to tear or rip, the thin film can be cut with scissors or some other sharp object. The thin film may be cut into smaller or larger pieces for different lengths of hair. The stylist is able to cut the person's hair with single or multiple thin films and chemical in place, by cutting right through the thin film and hair at the same time. The sections of hair are cut after the thin film is placed against them and after the chemical is applied to them. The ability to cut the hair with the film(s) and chemical in place facilitates a precision high-level style. The thin film(s) isolates the hair during the treatment process. The treated hair no longer has to be separated, after the film and chemical have been removed, from the other sections of hair in order to cut the hair. In this way, the stylist can cut exact sections of treated hair to a specific length.

Other substantial improvements in the use of the thin film included a noticeable weight reduction and increased handling characteristics including the ability to roll or fold the thin film. Stylists tend to multitask when styling a person's hair. Typically, the stylist has one hand occupied with a comb or scissor while manipulating an individual's hair with the other hand. Stylists require a lightweight, efficient, easy to use thin film when utilizing advanced styling techniques. Unlike thicker films, the thin film may be rolled or folded either lengthwise or widthwise. The stylist is able to hold and roll/fold the thin film onto itself using only one hand. Using this thin film, stylists are no longer required to hold a thicker film with one hand and reach for another thick film with a second hand in order to effectuate a sealing bond between two thick films. Furthermore, salon-operating costs are reduced because rolling or folding the thin film results in approximately half the number of films being used.

In summary, the thin film provides: (1) increases static conductivity, resulting in shorter chemical process time, greater sealing or bonding strength, reduced slippage of the firm and bleeding of the treatment; (2) allows the hair to be cut with the thin film and chemical in place; (3) reduces weight; (4) retains durability; (5) improves handling characteristics; and (6) lowers operating costs.

Figure 1C:
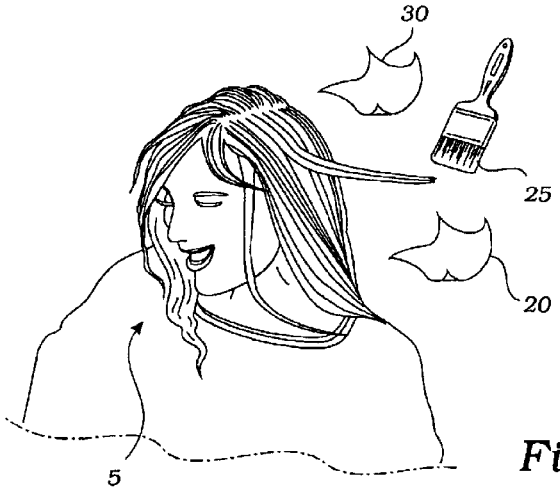
Figure 1D:
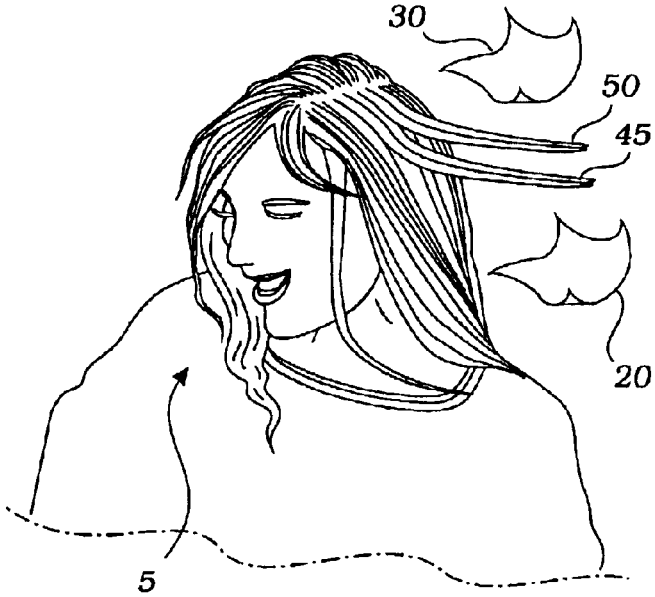

Turning now to FIG. 1*c*, the hair treatment method of the present invention may be accomplished using two or more separate thin films, e.g., 20 and 30. A particular section 15 of hair is weaved in order to isolate the section of hair for treatment. A first thin film 20 is placed against the sectioned hair 15. A chemical is applied to the sectioned hair with brush 25 or other suitable means. A second thin film 30 is placed against the first thin film 20. The second thin film 30 is placed against the first thin film 20 in such a way as to contain the sectioned hair 15 and chemical between the two thin films 20 and 30. Static conductivity facilitates sealing between the two thin films 20 and 30. Alternatively, the present invention allows the second film and a third film to be placed against the first film. This technique may be used when two different treatments are required to be preformed on the same section of hair, e.g. the same section of hair is colored one half white and one half black. Typically, when two thin films are used to contain the sectioned hair and chemical, there is no need to roll or fold the thin films. Static conductivity allows the thin films 20 and 30, to seal or bond together in a substantially flat arrangement. Typically, so long as the section 15 of hair and chemical are contained or sandwiched between the thin films 20, 30 the stylist is not required to perform the aforementioned steps in any particular order. For example, the stylist may prefer to apply the chemical to the section 15 of hair before placing the section against either thin film 20 or 30.

The sealing or bonding together of thin films in a substantially flat arrangement is facilitated by the use of similarly shaped thin films, that is films having substantially the same shape and size. The use of similarly shaped thin films allows maximum surface area contact between matching surfaces regardless of thin film shape. For example, the use of similarly shaped rectangular films would allow maximum surface area contact between both thin films with little or no exposed or non-contacted edge surface area. Typically, exposed surface area, which encourages folding or rolling of the film, increases with the use of dissimilarly shaped thin films. Thin film shapes may include, but are not limited to, rectangular, square, oval, triangular, and/or round.

Moving now to FIG. 1*d*, multiple thin films 20 and 30 may be used in conjunction with multiple sections of hair 40, 50. Typically, a first thin film 20 is placed against a first section of hair 45 and/or person's scalp. A first chemical is applied to the first section of hair 45. A second thin film 30 is place against a second section of hair 50 and/or person's scalp. A second chemical is applied to the second section of hair 50. The first thin film 20 and second thin film 30 are placed together. Static conductivity between the first thin film 20 and second thin film 30 facilitates sealing of the thin films 20 and 30. Sealing or bonding between the first thin film 20 and second thin film 30 contains the first section of hair 45 and first chemical between the two thin films 20 and 30. Static conductivity allows the thin films 20 and 30, to bond together in a substantially flat arrangement. Typically, so long as a section of hair and chemical are contained or sandwiched between thin films the stylist is not required to perform the aforementioned steps in any particular order. For example, the stylist may prefer to apply the chemicals to the sections 45, 50 of hair before placing the sections against their respective thin films 20 and 30.

Figure 2:
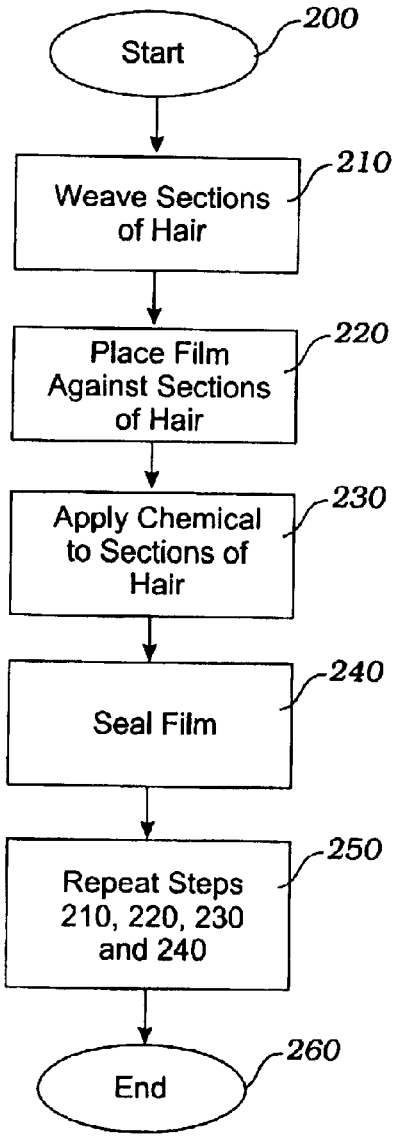
FIG. 2 is a flow chart illustrating a first embodiment of the present invention.
Figure 3:
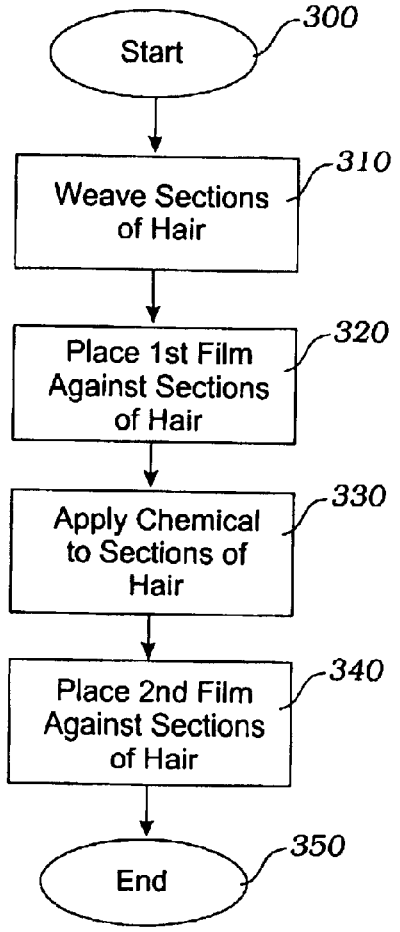
FIG. 3 is a flow chart illustrating second embodiment of the present invention.
Figure 4:
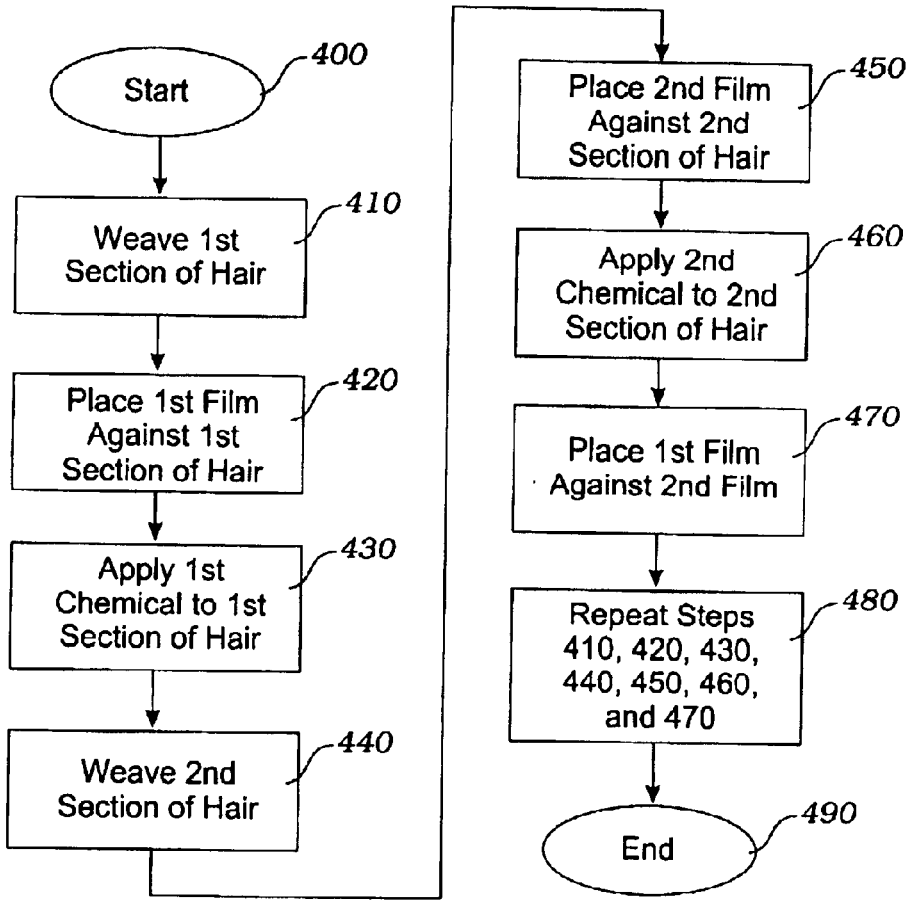
FIG. 4 is a flow chart illustrating a third embodiment of the present invention.

Turning now to FIGS. 2-4, flow charts illustrating alternative embodiments of the present invention are shown. In each of these embodiments, the film referred to is a thin film as described herein. In FIG. 2, the process begins at 200. At step 210, a person's hair is weaved in order to selectively isolate a section of hair for treatment. A film is placed against the selected section of hair, as seen at step 220. At step 230, a chemical is applied to the selected section of hair. Typically, rolling or folding, so that the selected section of hair and chemical are contained, as seen at step 240, seals the film. At step 250, steps 210 through 240 are repeated on other sections of hair as needed until the hair treatment is complete. The process ends at step 260.

Turning now to FIG. 3, a flow chart illustrating a second embodiment of the present invention is shown. The process begins at step 300. At step 310, a person's hair is weaved in order to selectively isolate a section of hair for treatment. A first film is placed against the selected section of hair, as seen at step 320. At step 330, a chemical is applied to the selected section of hair. This may include applying different colors to different portions of the section of hair, such as adjacent portions. Thus, the chemical applied to the first portion of the section of hair may be a first coloring agent, whereas the chemical applied to the second portion of the section of hair may be a second coloring agent associated with a color different than that of the first coloring agent. As shown in step 340, a second film is placed against the selected section of hair. The second film is placed against the first film in such as way as to contain the sectioned hair and chemical(s) between the two films. Static conductivity facilitates bonding between the first film and second film. Generally, when two films are used to contain the sectioned hair and chemical, there is no need to roll or fold the film. Typically, static conductivity allows the films to bond together in a substantially flat arrangement. The process ends at step 350, and may be repeated as necessary for other sections of hair. The hair may then be cut with the film in place if desired, and the film is then removed and washed (e.g., for reuse), and the hair is dried, styled, etc.

Turning now to FIG. 4, a flow chart illustrating a third embodiment of the present invention is shown. The process begins at step 400. At step 410, a person's hair is weaved in order to selectively isolate a first section of hair for treatment. A first film is placed against the first section of hair, as seen at step 420. At step 430, a first chemical is applied to the first section of hair. At step 440, a second section of hair is weaved. A second film is placed against the second section of hair, as shown in step 450. In step 460, a second chemical is applied to the second section of hair. Depending on the desired hairstyle, the first chemical and second chemical may be the same or entirely different. For example, the chemicals may be for different colors. Alternatively, the one chemical may be used for straightening or conditioning of the hair and another chemical may be use for coloring purposes. At step 470, the first film is placed against the second film. Static conductivity between the first film and second film facilitates bonding of the first film and the second film. Sealing or bonding between the first film and second film contains or sandwiches the first section of hair and first chemical between the first film and the second film. Typically, static conductivity allows the films to bond together in a substantially flat arrangement. At step 480, steps 410 through 470 are repeated on other sections of hair as needed until the hair treatment is complete. The process ends at step 490.

Figure 1E:
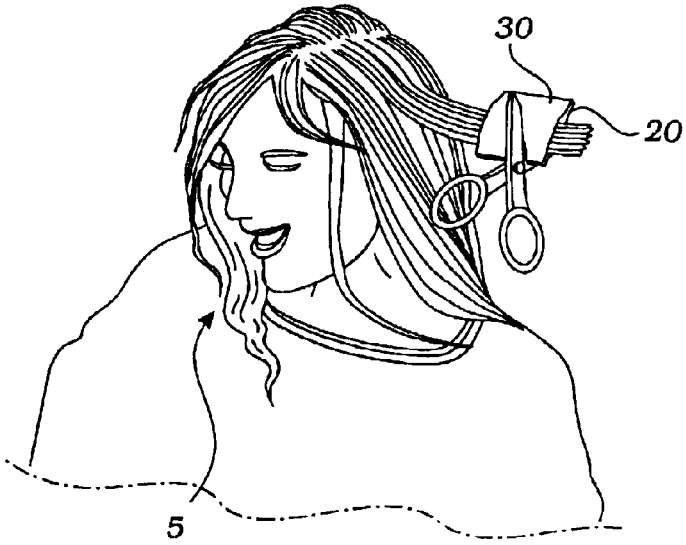

In each of the FIGS. 2-4, flow charts illustrating alternative embodiments of the present invention, the stylist may choose to style or cut, as shown in FIG. 1*e*, the person's hair with the thin film or films and chemical or chemicals in place. The ability to cut the hair with the film and chemical (s) in place facilitates a precision high-level style. The thin film isolates the hair during the treatment process. The treated hair no longer has to be separated, after the film and chemical have been removed, from the other sections of hair in order to cut the hair. Instead, the hair to be cut may be cut while the film is use, by cutting right through the film and hair at the same time. In this way, the stylist can cut exact sections of treated hair to a specific length.

While certain embodiments are illustrated in the drawings and are described herein, including preferred embodiments, it will be apparent to those skilled in the art that the specific embodiments described herein may be modified without departing from the inventive concepts described. For example, though the processes of the present invention arc illustrated herein with steps occurring in certain orders, the specific order of the steps is not required. Similarly, any range of thickness of the film within the range defined herein as "thin film" is acceptable, as is any particular thickness within that range.

What is claimed is:

1. A method of treating hair comprising the steps:

(a) weaving sections of a person's hair to be treated;

(b) placing a thin film against the sections of hair;

(c) applying a chemical to the sections of hair;

(d) sealing the thin film to contain the chemical and the sections of hair;

(e) repeating the steps of (a), (b), (c), and (d) for other sections of hair; and (f) cutting the sections of hair after the thin film is placed and the thin film, against the sections of hair and after the chemical is applied to the sections of hair.

2. The method of claim 1, wherein the thin film comprises polyethelyne terethylate.

3. The method of claim 1, wherein the thin film is substantially planar and substantially transparent, and comprises a polymer material.

4. The method of claim 1, wherein the step of sealing the thin film comprises folding a section of the thin film against another section of the thin film whereby static conductivity between the two sections of the thin film facilitates the sealing.

5. The method of claim 4, wherein the thin film has a thickness of approximately 0.049 mm to 0.025 mm.

6. The method of claim 4, wherein the thin film has a thickness of approximately 0.025 mm.

7. The method of claim 1, wherein the chemical is a first coloring agent, and further comprising the step of applying a second coloring agent to second sections of hair adjacent the sections of hair, wherein the second coloring agent is associated with a color different than that of the first coloring agent.

8. The method of claim 1, further comprising the step of placing the thin film against the person's scalp.

9. The method of claim 1, wherein the chemical modifies the sections of hair.

10. A method of treating hair comprising the steps:

(a) weaving sections of a person's hair to be treated;

(b) placing a first thin film against the sections of hair;

(c) applying a first chemical to the sections of hair;

(d) placing a second thin film against the sections of hair; and (e) cutting the sections of hair, the first thin film, and the second thin film, after the first thin film and second thin film are placed against the sections of hair and after the first chemical is applied to the sections of hair;

wherein the sections of hair are between the first thin film and the second thin film.

11. The method of claim 10, wherein the first thin film and the second thin film each comprise polyethelyne terethylate.

12. The method of claim 10, wherein the first thin film and the second thin film are substantially transparent, and the first thin film and the second thin film each comprise a polymer material.

13. The method of claim 12, wherein the first thin film and the second thin film each have a thickness of approximately 0.049 mm to 0.025 mm.

14. The method of claim 12, wherein the first thin film and the second thin film each have a thickness of approximately 0.025 mm.

15. The method of claim 12, wherein the first chemical is a first coloring agent, and further comprising the step of applying a second coloring agent to second sections of hair adjacent the sections of hair, wherein the second coloring agent is associated with a color different than that of the first coloring agent.

16. The method of claim 12, further comprising the step of repeating steps (a), (b), (c), and (d) to other sections of hair, using a second chemical instead of the first chemical for the other sections of hair.

17. The method of claim 12, wherein the chemical modifies the sections of hair.

18. The method of claim 12, further comprising the step of placing the first thin film against the person's scalp.

19. The method of claim 18, further comprising the step of placing the second thin film against the person's scalp.

20. The method of claim 12, wherein the first thin film and the second thin film are substantially the same size and shape.

21. A method of treating a person's hair comprising the steps:

(a) weaving a first section of hair to be treated;

(b) placing a first thin film against the first section of hair;

(c) applying a first chemical to the first section of hair;

(d) weaving a second section of hair to be treated;

(e) placing a second thin film against the second section of hair;

(f) applying a second chemical to the second section of hair;

(g) placing the first thin film against the second thin film containing the first section of hair therebetween;

(h) repeating steps (a), (b), (c), (d), (e), (f), and (g) for other sections of hair; and (i) cutting the first section of hair, the second section of hair, the first thin film, and the second thin film, after the first thin film and the second thin film are placed against the sections of hair, and after the first chemical and the second chemical are applied to the sections of hair.

22. The method of claim 21, wherein the first thin film and the second thin film each comprise polyethelyne terethylate.

23. The method of claim 21, wherein the first thin film and second thin film are substantially transparent, and of substantially the same size and shape, and each comprise a polymer material.

24. The method of claim 23, further comprising the step of placing the first thin film against the person's scalp.

25. The method of claim 24, further comprising the step of placing the second thin film against the person's scalp.

26. The method of claim 23, wherein the chemical modifies the section of hair.

27. The method of claim 21, wherein the first thin film and second thin film each have a thickness of approximately 0.049 mm to 0.025 mm.

28. The method of claim 21, wherein the first thin film and second thin film each have a thickness of approximately 0.025 mm.

29. The method of claim 21, wherein the first chemical is a first coloring agent, and the second chemical is a second coloring agent associated with a color different than that of the first coloring agent.

30. The method of claim 21, wherein the first chemical and the second chemical are the same.

* * * * *

UNITED STATES PATENT AND TRADEMARK OFFICE

CERTIFICATE OF CORRECTION

PATENT NO. : 6,820,624 B1
DATED : November 23, 2004
INVENTOR(S) : Palmeri

It is certified that error appears in the above-identified patent and that said Letters Patent is hereby corrected as shown below:

Column 8,
Lines 65-66, please change "after the thin film is placed and the thin film," to -- and the thin film after the thin film is placed --

Signed and Sealed this

Tenth Day of May, 2005

JON W. DUDAS
*Director of the United States Patent and Trademark Office*